US010145512B2

(12) United States Patent
Barker

(10) Patent No.: US 10,145,512 B2
(45) **Date of Patent: *Dec. 4, 2018**

(54) COMPRESSED NATURAL GAS STORAGE AND DISPENSING SYSTEM

(71) Applicant: R. Keith Barker, Walhalla, SC (US)

(72) Inventor: R. Keith Barker, Walhalla, SC (US)

(73) Assignee: HOLYSTONE USA, INC., Reisterstown, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/960,107

(22) Filed: Apr. 23, 2018

(65) Prior Publication Data

US 2018/0238494 A1 Aug. 23, 2018

Related U.S. Application Data

(63) Continuation-in-part of application No. 14/974,725, filed on Dec. 18, 2015, now Pat. No. 9,951,905, which is a continuation-in-part of application No. 14/161,245, filed on Jan. 22, 2014, now Pat. No. 9,360,161.

(60) Provisional application No. 61/849,207, filed on Jan. 22, 2013, provisional application No. 62/093,864, filed on Dec. 18, 2014.

(51) Int. Cl.
*F17C 5/06* (2006.01)
*F17C 5/00* (2006.01)

(52) U.S. Cl.
CPC ..... *F17C 5/06* (2013.01); *F17C 5/007* (2013.01); *F17C 2205/0138* (2013.01); *F17C 2205/0142* (2013.01); *F17C 2205/0326* (2013.01); *F17C 2221/033* (2013.01); *F17C 2223/0123* (2013.01); *F17C 2223/036* (2013.01); *F17C 2225/0123* (2013.01); *F17C 2225/036* (2013.01); *F17C 2227/0128* (2013.01); *F17C 2227/0157* (2013.01); *F17C 2227/0185* (2013.01); *F17C 2227/039* (2013.01); *F17C 2250/043* (2013.01); *F17C 2260/023* (2013.01); *F17C 2265/065* (2013.01); *F17C 2270/0139* (2013.01)

(58) Field of Classification Search
CPC .... F17C 5/06; F17C 5/007; F17C 2205/0326; F17C 2221/012; F17C 2223/0123
See application file for complete search history.

(56) References Cited

U.S. PATENT DOCUMENTS

| | | | |
|---|---|---|---|
| 5,351,726 | A | 10/1994 | Diggins |
| 5,409,046 | A | 4/1995 | Swenson |
| 5,499,739 | A | 3/1996 | Geist, III |
| 6,474,101 | B1 | 11/2002 | Quine |
| 7,624,770 | B2 | 12/2009 | Boyd |
| 8,899,278 | B2 | 12/2014 | Cohen |
| 2003/0192609 | A1 | 10/2003 | Enerson |
| 2007/0051423 | A1 | 3/2007 | Handa |
| 2011/0240139 | A1 | 10/2011 | Ding |

(Continued)

*Primary Examiner* — Timothy L Maust
*Assistant Examiner* — Timothy P Kelly
(74) *Attorney, Agent, or Firm* — Thomas C. Saitta

(57) ABSTRACT

A compressed natural gas storage and dispensing system having descending pressure bulk storage banks in fluid communication with a supply source for CNG and dispensing storage banks in fluid communication with the descending pressure bulk storage bank, both banks being in fluid communication with fuel dispensers, wherein the delivery pressure of the CNG during, simultaneous refueling of CNG powered vehicles is equalized.

19 Claims, 4 Drawing Sheets

(56) References Cited

U.S. PATENT DOCUMENTS

| | | | |
|---|---|---|---|
| 2014/0261863 | A1 | 9/2014 | Cohen |
| 2015/0090364 | A1 | 4/2015 | Elgowainy |

COMPRESSED NATURAL GAS STORAGE AND DISPENSING SYSTEM

This application is a continuation-in-part of U.S. Non-Provisional patent application Ser. No. 14/974,725, filed on Dec. 18, 2015, now U.S. Pat. No. 9,951,905, issued Apr. 24, 2018, claiming the benefit of U.S. Provisional Patent Application Ser. No. 62/093,864, filed on Dec. 18, 2014, the disclosure of which is incorporated herein by reference, U.S. Non-Provisional patent application Ser. No. 14/974,725 also being a continuation-in-part of U.S. Non-Provisional patent application Ser. No. 14/161,245, filed on Jan. 22, 2014, now U.S. Pat. No. 9,360,161, issued Jun. 7, 2016, claiming the benefit of U.S. Provisional Patent Application Ser. No. 61/849,207, filed on Jan. 22, 2013, the disclosure of which is incorporated herein by reference.

BACKGROUND OF THE INVENTION

This invention relates generally to the field of receiving, storing and dispensing compressed natural gas, and more particularly relates to systems and methods for receiving natural gas from various supply sources, such as pipelines, liquid natural gas storage units, or mobile delivery vehicles, compressing and storing the gas, and dispensing the natural gas to power various types of equipment, such as into vehicles from fuel islands, into micro-turbine generators at electric vehicle charging stations, into furnaces, etc.

For purposes of disclosure, the invention in various embodiments will be discussed primarily in detail in relation to a representative embodiment of storing and supplying compressed natural gas ("CNG") for use as a motor vehicle fuel, but it is to be understood that the invention is not limited to the particular end use of the dispensed CNG.

Using CNG for motor vehicle fuel is relatively new in the U.S. It is anticipated that most CNG fuel islands, designed and structured to dispense CNG to individual vehicles in the manner of standard gas stations, will obtain natural gas by direct connection to utility pipelines, as provided by municipal infrastructure. However, the gas pressure and volume from these pipelines is insufficient to support fast-fill, i.e., CNG-on-demand, islands. Inconsistent demands for natural gas throughout the day by neighboring customers sharing the pipeline create widely disparate volume and pressures that are detrimental for optimum operation of open-traffic fast-fill CNG fuel islands directed at refueling motor vehicles. Decreased pipeline pressure increases the time required to fuel vehicles, and as more vehicles convert to CNG, the fuel demand may exceed the supply available to any given fuel island because the island is dependent on the supply offered by the neighborhood pipeline at any given time.

Furthermore, traditional fast fill CNG stations employ either 1) cascade storage systems or 2) buffer systems, or 3) a combination of the two. The problem with these traditional systems is that they are not conducive to multiple vehicle, high volume dispensing demands, such that multiple vehicles cannot pull up at a CNG station at the same time and get fueled with CNG as fast as a gasoline vehicle can refuel at a traditional gas station. The stumbling block is that the known CNG systems are limited by the throughput of the natural gas pipeline and compressor.

A cascade storage system is a high-pressure gas cylinder system which is used for the refilling of smaller compressed gas cylinders. When gas contained in a cylinder at high pressure is allowed to flow to another cylinder containing gas at a lower pressure, the pressures will equalize to a value somewhere between the two initial pressures. Cascade systems typically employ three CNG tanks and a vehicle will first be filled from one of them, which will result in an incomplete fill, perhaps 2000 psi for a 3000 psi tank. The second and third tanks will bring the vehicle's tank closer to 3000 psi. The station typically has a compressor which refills the station's tanks using natural gas from the utility line. Each of the large cylinders is filled by a compressor, but the cascade system allows small cylinders to be filled without a compressor. This prevents accidentally overfilling the tank, which could happen with a system using a single fueling tank at a higher pressure than the target pressure for the vehicle.

The benefit of a cascade system is that it's a fast fill system. But the system is only fast until pressure in the storage cylinders decreases to an ineffective dispensing level. The fill rate is then limited to the speed of the compressor, which could be a significant problem when trying to fill more than one vehicle at the same time. If the cascade system is overburdened the pressure in the storage cylinders decreases to an inefficient or inoperable level before the compressor can refill storage cylinders.

Buffer fast-fill stations primarily fuel directly from the compressor into the vehicle and therefore require a smaller quantity of storage. These stations typically serve a captive fleet and are designed and sized for the need and fueling patterns of the specific fleet. They are often located onsite and allow for large quantities of fuel to be dispensed in a relatively short period of time. The advantage of the buffered system is its fast fuel dispensing. However, a disadvantage is that compressors are very expensive and the amount of gas available from the pipeline limits the dispensing output. In addition, utility costs to power the compressor can be very expensive if refueling is done at peak electricity times.

In a combination buffer/cascade system, the pipeline gas goes to the compressor and then fills up the buffered spherical tanks at, for example, 4200 psi, and these tanks are attached to the high side cascade tank, which fills the vehicle tank until it runs out of pressure, as stated above in the cascade system.

It is an object of this invention to address and solve the above problems by providing a system of CNG storage tanks and gas compressors which are designed to collect, store and compress natural gas on site in a manner that accounts for fluctuations in gas supply from pipelines or other sources and accounts for fluctuations in vehicle refueling demands or other dispensing circumstances. It is an object to provide such a system that is designed to maximize the speed and efficient dispensing of CNG utilizing in combination a descending pressure storage bank and a high-pressure, dispensing storage bank.

SUMMARY OF THE INVENTION

In various embodiments, a CNG storing and dispensing fuel island or other system is provided comprising preferably at least two banks or sets of tanks—a bank of "bulk storage tanks" and a bank of "dispensing storage tanks". The bulk storage tanks are connected to a natural gas utility pipeline, a liquid natural gas ("LNG") supply source, individual CNG or LNG delivery vehicles (e.g., trucks, trailers, railcars), or other natural gas supply sources and are refilled to capacity throughout the course of the day via open and continuous access to the supply source, the bulk storage tanks being refilled at the relatively low flow rate (produced by pipeline pressure via compressors that raise the pressure to 5000 psi for example). The dispensing storage tanks receive the gas from the hulk storage tanks as needed as a result of the fuel being dispensed from the dispensing tanks to the CNG dispensers and into motor vehicles or other end use equipment. The depletion is measured in pressure, such that when the dispensing storage tanks go below a designated minimum pressure, typically 3600 psi, valves that connect the two banks of tanks through a manifold system of pipes automatically transfer the gas stored in the bulk storage tanks into the dispensing storage tanks. To insure constant high pressure within the dispensing tanks, the gas from the bulk storage tanks is recompressed up to 5000 psi for example prior to delivery to the dispensing storage tanks. Because a relatively low flow rate for filling the bulk storage tanks is acceptable, relatively low horse power compressors may be utilized. Likewise, relatively low horsepower compressors may be utilized to re compress the gas delivered from the bulk storage tanks, since the gas will be at a pressure of greater than 3600 psi. As stated, this same design can also be employed to accommodate other CNG sources, such as a tube trailer, or liquid natural gas (LNG), where the source of the natural gas is an LNG tanker instead of a municipal utility gas pipeline, for example.

In an alternative embodiment, a CNG fast-fill receiving, storing and dispensing fuel island is provided comprising preferably at least two banks or sets of tanks—a bank of descending pressure bulk storage tanks and a bank of high pressure (i.e., at a higher pressure than the descending pressure tanks), dispensing storage tanks. Alternatively, a single large capacity tank may be substituted for the bank of descending pressure bulk storage tanks or for the bank of dispensing storage tanks, or two large capacity storage tanks may be utilized to replace both banks. A natural gas pipeline, portable CNG delivery tanks, or portable LNG delivery tanks may be used to supply the system. CNG from the descending pressure bulk storage bank is initially dispensed through fuel dispensers to fuel for example a vehicle. If dispenser sensors indicate that the vehicle has not reached complete fill due to CNG gas temperature, ambient temperature, and/or internal vehicle tank pressures or temperatures, then CNG from the dispensing storage bank is dispensed to fill the vehicle tank. The dispensing storage bank is resupplied with CNG delivered from the descending pressure bulk storage bank through a secondary or re-compressor. For a fuel dispenser with one CNG inlet, CNG from the descending pressure bulk storage bank and from the dispensing storage bank is routed through a manifold valve, with suitable back flow prevention valves being utilized. This design is also preferred for installations wherein the dispensers are located at farther distances from the CNG storage banks. For a fuel dispenser with two CNG inlets, the CNG from the descending pressure bulk storage bank and from the dispensing storage bank is routed through the dispenser, which itself determines if CNG from the high pressure, dispensing storage bank is needed for a complete vehicle fill. Pressure transducer switches control CNG flow through the various conduits.

In alternative manner the invention may be described as a compressed natural gas (CNG) storage and dispensing system comprising a descending pressure bulk storage bank in fluid communication with a natural gas supply source; a high pressure, dispensing storage bank in fluid communication with said descending pressure bulk storage bank; at least one dispenser adapted to refuel a CNG powered vehicle, each said at least one dispenser in fluid communication with said descending pressure bulk storage bank and with said dispensing storage bank; and a re-compressor in fluid communication with said descending pressure bulk storage bank and said dispensing storage bank, whereby CNG is delivered from said decreasing pressure bulk storage bank to said dispensing storage bank as needed to refill said dispensing storage bank. Furthermore, the invention wherein said natural gas supply source comprises a natural gas pipeline, and said system further comprises a primary compressor in fluid communication with said natural gas pipeline and said descending pressure bulk storage bank; wherein said natural gas supply source comprises transportable LNG supply tanks; wherein said natural gas supply source comprises transportable CNG supply tanks; wherein said at least one dispenser comprises a single inlet, and further wherein said descending pressure bulk storage bank and said dispensing storage bank are in fluid communication with said at least one dispenser through a manifold valve; wherein said at least one dispenser comprises two inlets, and further wherein said descending pressure bulk storage bank is in fluid communication with said at least one dispenser through one of said inlets and wherein said dispensing storage bank is in fluid communication with said at least one dispenser through the other of said inlets; further comprising a direct conduit between said dispensing storage bank and said descending pressure bulk storage bank such that CNG may be delivered from said descending pressure bulk storage bank directly to said dispensing storage bank as needed to refill said high pressure storage bank; wherein CNG is delivered through said manifold valve to said at least one dispenser first from said descending pressure storage bank and second from said dispensing storage bank; wherein CNG is delivered simultaneously to said at least one dispenser from said descending pressure storage bank and said dispensing storage bank; further comprising a backflow preventer and a temperature reducing heat exchanger in fluid communication between said re-compressor and said high pressure storage bank; wherein either or both said descending pressure bulk storage bank and said dispensing storage bank comprise a plurality of tanks; wherein either or both said descending pressure bulk storage bank and said dispensing storage bank comprise storage vaults; wherein either or both said descending pressure bulk storage bank and said dispensing storage bank are positioned below ground; further comprising a temperature decreasing heat exchanger in fluid communication with said primary compressor and said descending pressure bulk storage bank; further comprising a temperature increasing heat exchanger in fluid communication with said transportable LNG supply tanks and said descending pressure bulk storage bank; further comprising a temperature decreasing heat exchanger in fluid communication with said transportable CNG supply tanks and said descending pressure bulk storage bank; wherein said natural gas supply source is also in fluid communication with said re-compressor; and/or wherein said at least one dispenser comprises multiple fueling nozzles and controls the delivery of CNG from said descending pressure bulk storage bank and said dispensing storage bank such that the delivery pressure is equalized through all said fueling nozzles.

Alternatively, the invention is a compressed natural gas (CNG) storage and dispensing system comprising a descending pressure bulk storage bank in fluid communication with a natural gas supply source, said natural gas supply source being chosen from the group of natural gas supply sources consisting of a natural gas pipeline, transportable CNG supply tanks and transportable LNG supply tanks; a high pressure storage bank in fluid communication with said descending pressure bulk storage bank; at least one dispenser adapted to refuel a CNG powered vehicle or other CNG burning equipment, each said at least one dispenser in fluid communication with said descending pressure bulk storage bank and with said dispensing storage bank; wherein said at least one dispenser comprises one or more inlets, such that wherein said at least one dispenser comprises a single inlet, said descending pressure bulk storage bank and said dispensing storage bank are in fluid communication with said at least one dispenser through a manifold valve, and wherein said at least one dispenser comprises two inlets, said descending pressure bulk storage bank is in fluid communication with said at least one dispenser through one of said inlets and wherein said high pressure storage bank is in fluid communication with said at least one dispenser through the other of said inlets, and wherein said at least one dispenser comprises multiple fueling nozzles and is adapted to control the delivery of CNG from said descending pressure bulk storage bank and said dispensing storage bank such that the delivery pressure is equalized through all said fueling nozzles; a re-compressor, a backflow preventer and a temperature reducing heat exchanger in fluid communication with said descending pressure bulk storage bank and said dispensing storage bank; and a direct conduit between said dispensing storage bank and said descending pressure bulk storage bank, said direct conduit bypassing said re-compressor.

Alternatively, the invention is a method of refueling CNG powered vehicles or other CNG fueled equipment or machinery comprising the steps of providing a compressed natural gas (CNG) storage and dispensing system comprising a descending pressure bulk storage bank in fluid communication with a natural gas supply source, said natural gas supply source being chosen from the group of natural gas supply sources consisting of a natural gas pipeline, transportable CNG supply tanks and transportable LNG supply tanks; a high pressure, dispensing storage bank in fluid communication with said descending pressure bulk storage bank; at least one dispenser adapted to refuel a CNG powered vehicle or other CNG fueled equipment or machinery, each said at least one dispenser in fluid communication with said descending pressure bulk storage bank and with said dispensing storage bank; wherein said at least one dispenser comprises multiple fueling nozzles and is adapted to control the delivery of CNG from said descending pressure bulk storage bank and said dispensing storage bank such that the delivery pressure is equalized through all said fueling nozzles; and a re-compressor, a backflow preventer and a temperature reducing heat exchanger in fluid communication with said descending pressure bulk storage bank and said dispensing storage bank; providing CNG to said descending pressure bulk storage bank and to said dispensing storage bank such that the pressure within both said banks is at least approximately 4200 psi; delivering CNG to one or more CNG powered vehicles or other CNG fueled equipment or machinery through said at least one dispensers, wherein said CNG is first delivered from said descending pressure bulk storage bank and then subsequently delivered from said dispensing bulk storage tank, and equalizing the delivery pressure of said CNG delivered to said one or more CNG powered vehicles or other CNG fueled equipment or machinery; refilling said descending pressure bulk supply bank from one of said natural gas supply sources as needed; and refilling said high pressure storage bank with CNG from said descending pressure storage bank as needed by delivering CNG from said descending pressure storage bank through said re-compressor.

Alternatively, the invention is a compressed natural gas (CNG) storage and dispensing system comprising: a descending pressure bulk storage bank in fluid communication with a natural gas supply source; a dispensing storage bank in fluid communication with said descending pressure bulk storage bank; at least one dispenser adapted to provide CNG to a CNG-powered device, each said at least one dispenser in fluid communication with said descending pressure bulk storage bank and with said dispensing storage bank; and a re-compressor in fluid communication with said descending pressure bulk storage bank and said dispensing storage bank, whereby CNG is delivered from said decreasing pressure bulk storage bank to said dispensing storage bank as needed to refill said dispensing, storage bank; wherein said at least one dispenser comprises two inlets, and further wherein said descending pressure bulk storage bank is in fluid communication with said at least one dispenser through one of said inlets and wherein said dispensing storage bank is in fluid communication with said at least one dispenser through the other of said inlets. Furthermore, such a system wherein said natural gas supply source comprises a natural gas pipeline, and said system further comprises a primary compressor in fluid communication with said natural gas pipeline and said descending pressure bulk storage bank; wherein said natural gas supply source comprises transportable LNG supply tanks; wherein said natural gas supply source comprises transportable CNG supply tanks; further comprising a direct conduit between dispensing storage bank and said descending pressure bulk storage bank such that CNG may be delivered from said descending pressure bulk storage bank directly to said dispensing storage bank as needed to refill said dispensing storage bank; wherein CNG is delivered simultaneously to said at least one dispenser from said descending pressure storage bank and said dispensing storage bank; wherein said at least one dispenser comprises multiple fueling nozzles and controls the delivery of CNG from said descending pressure bulk storage bank and said dispensing storage bank such that the delivery pressure is equalized through all said fueling nozzles; wherein either or both said descending pressure bulk storage bank and said dispensing storage bank comprise a plurality of tanks; and/or further comprising a temperature reducing heat exchanger in fluid communication with said primary compressor and said descending pressure bulk storage bank; wherein said temperature reducing heat exchanger reduces the temperature of said CNG passing between said primary compressor and said descending pressure bulk storage bank.

Alternatively, the invention is a compressed natural gas (CNG) storage and dispensing system comprising: a descending pressure bulk storage bank in fluid communication with a natural gas supply source; a dispensing storage bank in fluid communication with said descending pressure bulk storage bank; at least one dispenser adapted to provide CNG to a CNG-powered device, each said at least one dispenser in fluid communication with said descending pressure bulk storage bank and with said dispensing storage bank; and are compressor in fluid communication with said descending pressure bulk storage bank and said dispensing storage bank, whereby CNG is delivered from said decreasing pressure bulk storage bank to said dispensing storage bank as needed to refill said dispersing storage bank; further comprising a backflow preventer in fluid communication between said re-compressor and said dispensing storage bank. Furthermore, such a system wherein said at least one dispenser comprises a single inlet, and further wherein said descending pressure bulk storage bank and said dispensing storage bank are in fluid communication with said at least one dispenser through a manifold valve; wherein CNG is delivered through said manifold valve to said at least one dispenser first from said descending pressure storage bank and second from said dispensing storage bank; wherein said at least one dispenser comprises multiple fueling nozzles and controls the delivery of CNG from said descending pressure bulk storage bank and said dispensing storage bank such that the delivery pressure is equalized through all said fueling nozzles; wherein either or both said descending pressure bulk storage bank and said dispensing storage bank comprise a plurality of tanks; further comprising an actuator valve in communication with a low pressure sensor monitoring the pressure of CNG delivered to said at least one dispenser, said actuator valve controlling delivery of CNG from said dispensing storage bank; and/or further comprising a first backflow preventer valve in fluid communication between said dispensing storage bank and said manifold valve and a second backflow preventer valve in fluid communication between said descending pressure storage bank and said manifold valve.

Alternatively the invention is a method of delivering CNG to a CNG-powered device comprising the steps of: providing a compressed natural gas (CNG) storage and dispensing system comprising: a descending pressure bulk storage bank in fluid communication with a natural gas supply source, said natural gas supply source being chosen for the group of natural gas supply sources consisting of a natural gas pipeline, transportable CNG supply tanks and transportable LNG supply tanks; a dispensing storage bank n fluid communication with said descending pressure bulk storage bank; at least one dispenser adapted to deliver CNG to a CNG-powered device, each said at least one dispenser in fluid communication with said descending pressure bulk storage bank and with said dispensing storage bank; wherein said at least one dispenser comprises multiple fueling nozzles and is adapted to control the delivery of CNG from said descending pressure bulk storage bank and said dispensing storage bank such that the delivery pressure is equalized through all said fueling nozzles; and a re-compressor in fluid communication between said descending pressure bulk storage bank and a backflow preventer in fluid communication between said re-compressor and said dispensing storage bank; providing CNG to said descending pressure bulk storage bank and to said dispensing storage bank; delivering CNG to a CNG-powered device through said at least one dispenser, wherein said CNG is first delivered from said descending pressure bulk storage bank and then subsequently delivered from said dispensing bulk storage bank in response to a drop in pressure within said descending pressure bulk storage bank below a predetermined pressure minimum, and equalizing the delivery pressure of said CNG delivered to said CNG-powered device; refilling said descending pressure bulk supply bank from one of said natural gas supply sources as needed; and refilling said dispensing storage bank with CNG from said descending pressure storage bank as needed by delivering CNG from said descending pressure storage bank through said re-compressor. Furthermore, such method providing a first backflow preventer valve in fluid communication between said dispensing storage bank and said manifold valve and a second backflow preventer valve in fluid communication between said descending pressure storage bank and said manifold valve; and/or providing an actuator valve in communication with a low pressure sensor monitoring the pressure of CNG delivered to said at least one dispenser, said actuator valve controlling delivery of CNG from said dispensing storage bank.

DETAILED DESCRIPTION

Figure 1:
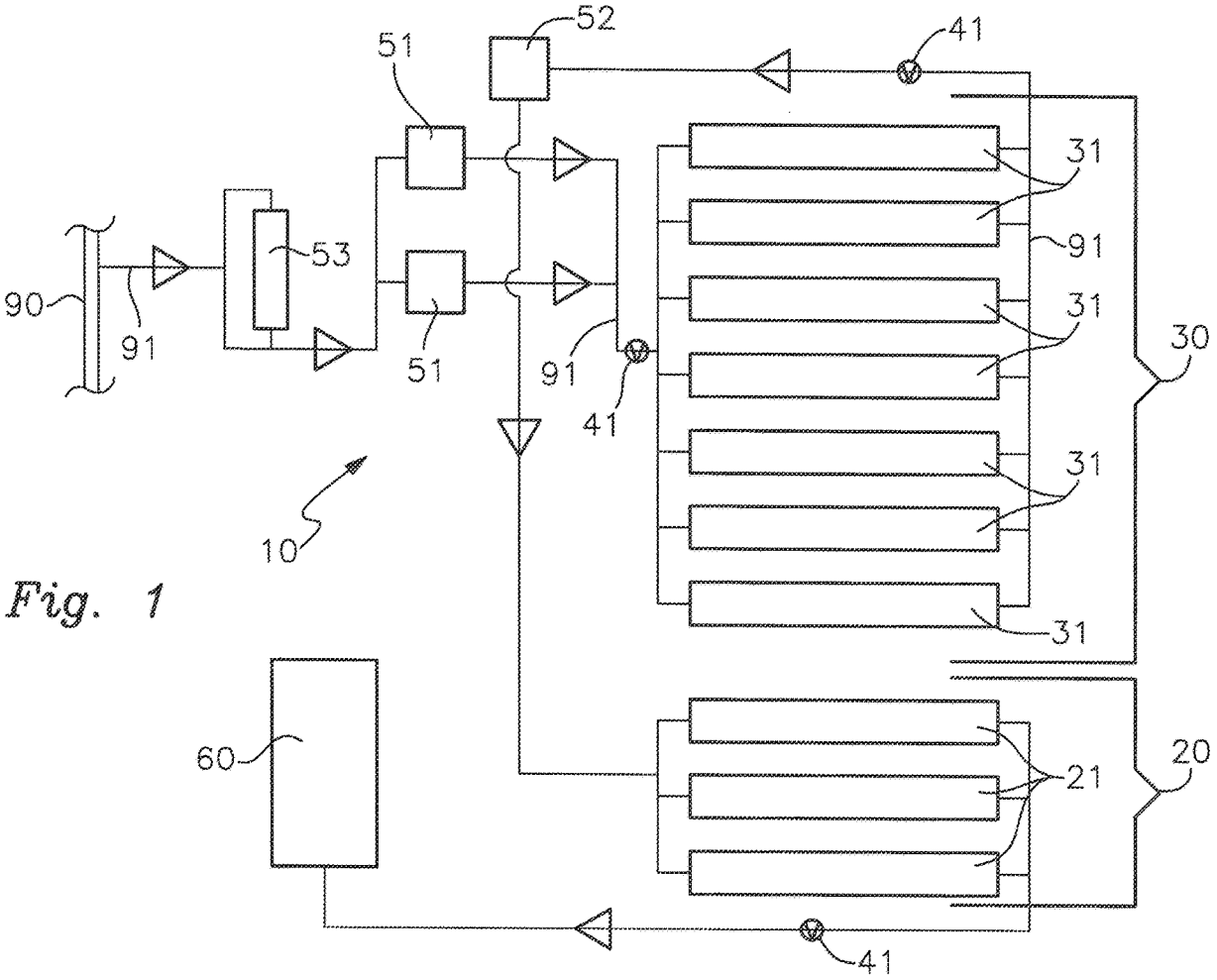
FIG. 1 is a schematic illustration of an embodiment of a CNG receiving, storing and dispensing fuel island system.

With reference to the drawings, embodiments of the invention will now be described in enabling detail. The drawings are provided for the purpose of illustration and disclosure, and are not meant to be limiting as to embodiments of the invention. In general, the invention is CNG receiving, storing and dispensing system or method that comprises a descending pressure bulk storage bank, preferably comprising a plurality of tanks, a high pressure, dispensing storage bank, preferably comprising a plurality of tanks, the term "high pressure" being in relation to the pressure within the descending pressure bulk storage bank, a CNG dispenser, either single inlet or double inlet, to deliver CNG to CNG-powered devices, such as for example vehicles, turbines, furnaces or any other equipment, machinery or the like utilizing CNG as a fuel or power source. The CNG receiving, storing and dispensing system or method receives natural gas from any of various supply sources, such as fixed pipelines, LNG storage tanks, batch mobile CNG or LNG delivery means such as tankers, trailers, railroad cars, etc. As used herein, the term CNG shall also be taken to include blended compressed natural gas and hydrogen ("HCNG"), with hydrogen present at less than 20%, and renewable natural gas ("RNG") created by methanisation of hydrogen.

An exemplary embodiment of the method and system is a CNG receiving, storing and dispensing fast-fill fuel island system 10 adapted to receive vehicular traffic acquiring CNG on demand, the system 10 comprising preferably at least two banks or sets of CNG storage tanks—a bank 20 of dispensing storage tanks 21 and a bank 30 of bulk storage tanks 31. The bulk storage tanks 31 are connected to the natural gas utility pipeline 90 and are continuously being filled to capacity throughout the course of the day as needed via open and continuous conduits 91 communicating with the pipeline 90, with the gas being suctioned from the pipeline 90 and compressed by primary compressors 51 to the desired pressure (5000 psi for example). The dispensing storage tanks 21 receive the gas from the bulk storage tanks 31 as needed as a result of the fuel being dispensed through the CNG fuel dispensers 60. A dryer system 53 may be provided between the pipeline 90 and the primary compressors 51. The depletion of the dispensing storage tanks 21 is measured in pressure, such that when any of the dispensing storage tanks 21 go below a designated minimum pressure (3600 psi for example), typically chosen to be the minimum pressure required for delivery of the CNG into the motor vehicles in a reasonably short time period, valves 41 that connect the two banks 20/30 of tanks 21/31 through a manifold system of pipes 40 automatically transfer the gas stored in the bulk storage tanks 31 into the dispensing storage tanks 21. To insure constant high pressure within the dispensing storage tanks 21, the gas from the bulk storage tanks 31 is recompressed prior to delivery to the dispensing storage tanks 21 by secondary compressors 52.

The source of the natural gas can be either a municipal utility gas pipeline 90, a mobile CNG tube trailer (not shown), or from a large volume mobile tanker storing LNG (not shown). In the event of LNG, the liquid must first be converted into a gaseous state. Once in the gaseous state, the process is the same as described in general above. The gas is drawn into the system through suction caused by one or more primary compressors 51.

The storage tank banks 20 and 30 are connected together with manifold pipelines 40 and appropriate valves 41. Preferably the tanks 21/31 are resin composite tanks of the type known in the industry as type 4, 4/5 or 5, as tanks of this composition are capable of holding more gas at high pressure and at lower cost of manufacture than conventional metal tanks.

The number of tanks 21/31 is dependent on how much fuel will need to be stored and how much fuel should be available for dispensing at a particular site dependent on demand. A sufficient number of dispensing storage tanks 21 should be provided to meet the projected peak fueling requirements of the fuel island system 10, to be measured in standard cubic feet per minute (scfm). The number of bulk storage tanks 31 is determined as a result of the expected demand on the dispensing storage tanks 21, but there will be a significantly greater number of bulk storage tanks 31 than dispensing storage tanks 21. The bulk storage tanks 31 are filled in sequence through the action of primary compressors 51 that compress the natural gas delivered at low pressure from the pipeline 90 or other source up to a desired high pressure (5000 psi for example), and are filled whenever the pressure within a hulk storage tank 31 falls below a predetermined pressure, regardless of whether or not fuel is being dispensed through a dispensing storage tank 21. Because of the large number of bulk storage tanks 31, the refilling process can be at a relatively low flow rate, since the supply of natural gas is continuous and draw down on the bulk storage tanks 31 occurs only during refilling of the dispensing storage tanks 21 whenever pressures in the dispensing storage tanks 21 are reduced to predetermined minimum levels (3600 psi for example).

Compressors 51/52 draw the gas through the system 10 via suction, the compressors 51/52 being activated by sensors when pressure in either the bulk storage tanks 31 or the dispensing storage tanks 21 is reduced to a predetermined level. The valves 41 that transfer the gas to and from tanks 21/31 and compressors 51/52 operate automatically based on pressures, timers and temperatures, with the valves 41 being monitored by a sequencing panel. The sequencing panel will also have the ability to allow manual override of the valves 41. The goal of the storage system 10 is to insure the dispensing storage tanks 21 are filled to maximum fuel capacity at all times. The storage system 10 will also have safety monitoring for fire, smoke, heat, and UV hydrocarbon detection with overhead fire protection deployment such as sprinkler systems loaded with fire suppressants.

A major advantage of the system as described is its ability to provide to the CNG dispensers 60 a sufficient quantity of CNG at the desired minimum pressure for efficient delivery to the motor vehicles, wherein the source of the natural gas is a low pressure, low flow rate and fluctuating volume source, by utilizing relatively low horsepower compressors 51/52. For example, 50-150 horsepower compressors 51/52 may be utilized. Conventionally such low horsepower compressors would not be able to provide GNU above a minimum desired psi at a flow rate suitable for refilling vehicles in a timely manner, and therefore known systems utilize compressors of much greater horsepower, which are incrementally more expensive. Because the filling of the bulk storage tanks 31 does not need to be rapid and instead may be accomplished over long time periods, and because the CNG delivered from the bulk storage tanks 31 is passed through secondary compressors to recompress the CNG prior to delivery to the dispensing storage tanks 21, these 50-150 horsepower compressors are sufficient.

As a prophetic example shown in FIG. 1, natural gas comes in off natural gas pipeline 90 from existing municipal gas utility infrastructure onto the property through conduit 91. The gas is sucked through the conduit 91 by suction created by a pair of primary compressors 51. The conduit 91 carries the gas through a dryer system 53 into the primary compressors 51 where it is compressed to 4,200 psi (the industry standard) or higher and sequenced throughout the manifold pipes 40 and into the bulk storage tanks 31. In the prophetic example, there are 10 total cylindrical storage tanks 21 and 31. These 10 tanks are partitioned into two sets or banks, shown as bank 20 of the dispensing storage tanks 21 and bank 30 of the bulk storage tanks 31.

Bank 20 provides fuel to the fuel dispensers 60 on demand. When the pressure within the dispensing storage tanks 21 falls below 3600 psi, valves 41 open to draw gas from bank 30 into bank 20, the gas drawn from tanks 31 being recompressed to at least 4,200 psi or higher prior to delivery to band 20. Preferably, gas will be drawn from tanks 31 sequentially, such that when pressure in a first bulk storage tank 31 falls below the predetermined, minimum pressure, output from the first tank 31 is stopped and gas is taken from a second tank 31, etc., until all dispensing tanks 21 are refilled. When output from the first tank 31 is stopped, or even possibly during the delivery of gas from the first tank 31, primary compressors 51 start refilling of this first bulk storage tank 31 from the natural gas source pipeline 90. This system insures that there will always be a sufficient supply of natural gas at the required pressure (4,200 psi or higher) to be used as needed by fuel island demand.

Preferably, the tanks 21/31 in the example are designed to handle at least 5,000 psi, and preferably higher, and should be cylindrical and double stacked; a suitable size being 21 inches in diameter and 84 inches long, so they can fit below grade into the fuel island culvert design of patent application Ser. No. 13/506,898. As previously discussed, type 4, 4/5 or 5 tanks composed of a resin or hybrid are preferred. The same system can be employed above ground, independent of the fuel island culvert design. The higher the psi, the more gas can be stored in the tanks 21/31. Whenever psi falls to 3,600 or below, the tanks 21/31 will automatically refill from their respective source via the compressor units 51/52.

The system 10 as described comprises features advantageous, novel and non-obvious over the known prior art systems. The system allows for reduced time to fill-up using CNG, similar to conventional fueling with gasoline or diesel; greater access to CNG fueling for non-fleet vehicles, as most CNG stations are restricted to fleets due to the time it takes to fill a vehicle and the limited supply of CNG available for compression; which results in most fleet CNG stations scheduling fill-ups by appointment only; uninterrupted, continuous and systematic supply of CNG fuel to dispenser(s); CNG stations will be more attractive to investors and more accepting by the public because CNG will be dispensed faster and efficiently without the fear of spending too much time at a dispenser and without fear of not having enough fuel to fill up at a convenient time and will have lower installation and operational costs.

Figure 2:
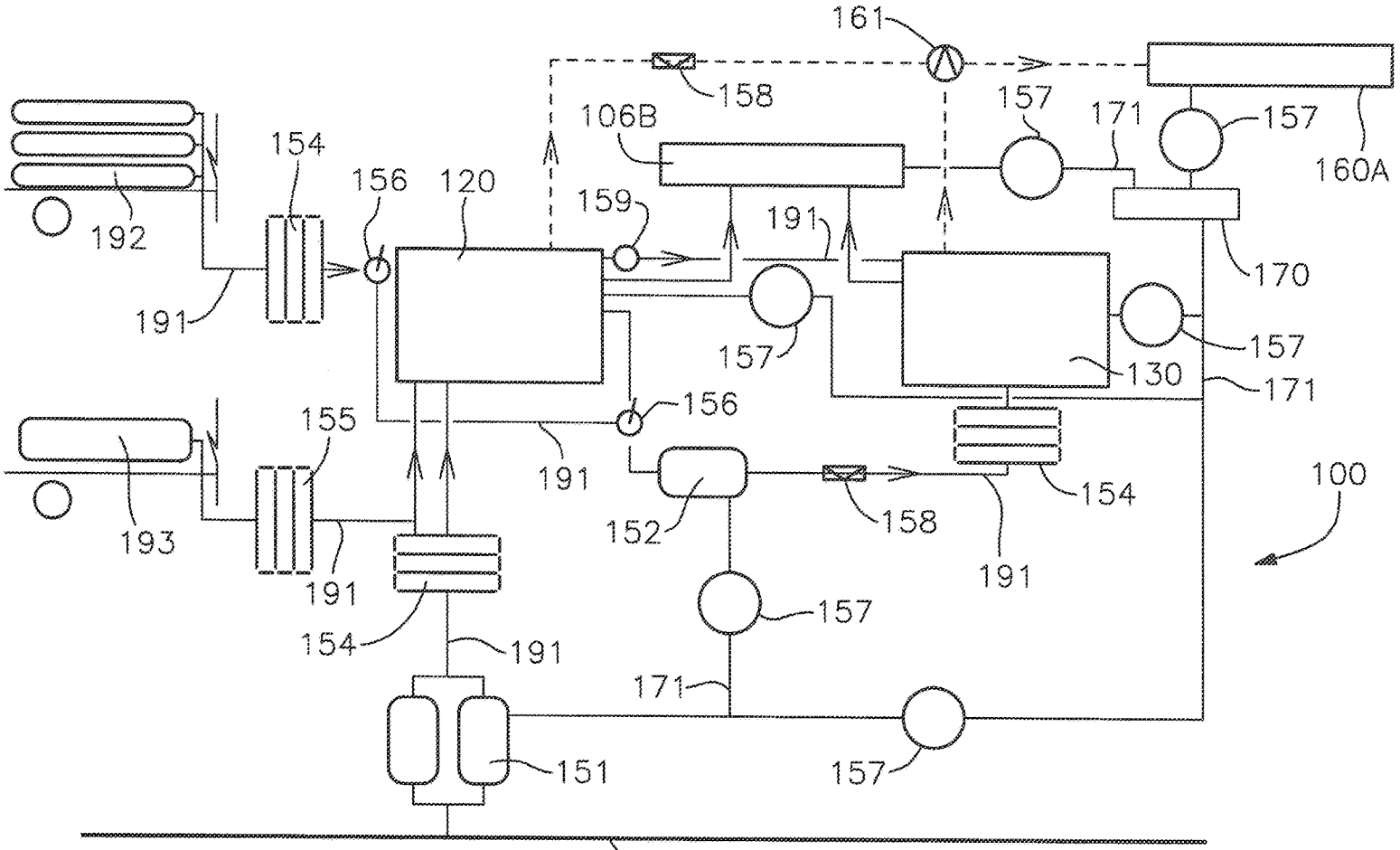
FIG. 2 is a schematic illustration of an alternative embodiment of the CNG receiving, storage and dispensing fuel island system utilizing a descending pressure bulk storage bank and a high pressure, dispensing bulk storage bank.

An alternative and more preferable embodiment of the CNG storage and dispensing system 100 and method is illustrated in FIG. 2. In the illustration, CNG conduits 191 and control panel circuitry 171 with pressure transducer switches 157 in communication with a control panel 170 are utilized for movement of the CNG and for control of the flow path, respectively. The system 100 is illustrated as being supplied by three different fuel supply sources, and it is to be understood that system 100 may be structured to be supplied by one, two or all three supply sources. A first possible supply source is CNG delivered by transportable CNG supply tanks 192, such as may be loaded off-site and transported by truck or trailer to the CNG storage and dispensing system 100. An onboard re-compressor may be provided if necessary. The CNG from the transportable CNG supply tanks 192 is passed through a temperature reducing heat exchanger 154 and, via directional valve 156, either directly into the descending pressure bulk storage bank 120 or through a second directional valve 156 into a secondary or re-compressor 152, through a backflow preventer 158, through a second temperature reducing heat exchanger 154 and into the high pressure dispensing bulk storage bank 130. A second possible supply source is LNG delivered by transportable LNG supply tanks 193 and possibly stored onsite in an LNG storage tank, therein the LNG is allowed to vaporize into CNG and pass through a temperature increasing heat exchanger 155, after which the CNG is delivered to the descending pressure bulk storage bank 120. A third possible supply source is a natural gas pipeline 190. Natural gas is delivered to a primary compressor 151, preferably duplex compressors, and the CNG so produced is delivered through a temperature reducing heat exchanger 154 to the descending pressure bulk storage bank 120.

The descending pressure bulk storage bank 120 is a repository for a large volume of CNG, preferably approximately 2500 GGE (gasoline gallon equivalents) for example, and the bank 120 may be formed by a plurality of individual CNG tanks linked together in a manifold system. Alternatively, the descending pressure bulk storage bank 120 may comprise a single large CNG tank or vault. Descending pressure storage bank 120 may be above or below ground, with underground tanks or vault being preferred as this increases available surface space and is better the temperature control, since a 10 degree F. change may increase or decrease the pressure in the tanks or vault by approximately 100 psi. Bank 120 is the initial or primary source for delivery of CNG to dispensers 160 to refuel CNG powered vehicles, and is characterized as a descending pressure system since the pressure within the bank 120 drops as CNG is dispensed. The descending pressure bulk storage bank 120 is preferably maintained at a pressure of approximately 4200 psi or more. When the pressure within the descending pressure bulk storage bank 120 drops to a pressure such that the delivery pressure of the CNG is inadequate for refueling the vehicles, such as down to 3600 psi for example, delivery of CNG from the descending pressure bulk storage bank 120 is halted and delivery from the high pressure, dispensing storage bank 130 to the dispensers 160 and refueling vehicles is commenced. The descending pressure bulk storage bank 120 is then refilled with CNG from one or more of the supply sources 192/193/190 to bring the pressure hack up to the acceptable 4200 psi or more. In most cases the system refill can be accomplished during low demand periods, such as during the night.

The high pressure, dispensing storage bank 130 is a repository for a volume of CNG less than the volume of the descending pressure bulk storage bank 120, such as approximately 500 GGE for example, and the bank 130 may be formed by a plurality of individual CNG tanks linked together in a manifold system. Alternatively, the high pressure, dispensing bulk storage bank 130 may comprise a single large CNG tank or vault. High pressure storage bank 120 may be above or below ground, with underground tanks or vault being preferred as this increases available surface space and is better for temperature control, since a 10 degree F. change may increase or decrease the pressure in the tanks or vault by approximately 100 psi. Bank 130 is the secondary source for delivery of CNG to dispensers 160 to refuel CNG powered vehicles and is utilized when the pressure in the descending pressure bulk storage bank 120 has dropped to a point of inefficiency. The high pressure, dispensing storage bank 130 is preferably filled and refilled by transferring CNG from the descending pressure bulk storage bank 120 to the high pressure, dispensing storage bank 130 through the re-compressor 152, the backflow preventer 158 and the temperature reducing heat exchanger 154, the re-compressor 152 increasing the pressure of the CNG up to the desired 4200 psi or more. Alternatively, if the duplex compressors 151 are in operation and the descending pressure bulk storage bank 120 is at full pressure, the high pressure, dispensing storage bank 130 may be refilled directly by delivering CNG from the descending pressure bulk storage bank 120 to the high pressure, dispensing storage bank 130 through a direct conduit 191 controlled by a directional regulator valve 159. Further alternatively, the high pressure, dispensing storage bank 130 may be filled and refilled directly from one of the supply sources 192/193/190, such as by providing a conduit 191 from the duplex compressors 151 in communication with the natural gas pipeline 190 and passing the CNG through a temperature reducing heat exchanger 154.

The dispensers 160 operate in known manner for CNG dispensers. Dispensers 160 may be single or multiple fueling nozzle units. In one system, single inlet dispensers 160A are utilized. CNG from the descending pressure bulk storage bank 120 is passed through a backflow preventer 158 and a manifold valve 161 to the single inlet dispensers 160A. CNG from the high pressure, dispensing storage bank 130 is also passed through the manifold valve 161 to the single inlet dispensers 160A. The initial dispensing operation is performed only with CNG from the descending pressure bulk storage bank 120. When the CNG delivery pressure from the descending pressure bulk storage bank 120 is insufficient for complete fueling of the vehicle due to various factors (CNG temperature, ambient temperature, vehicle tank pressures and temperatures) as determined by sensors of known type in the dispensers or by pressure transducer sensors 157 in communication with the control panel 170, flow from the descending pressure bulk storage bank 120 is halted and flow from the high pressure, dispensing storage bank 130 is activated.

In an alternative system, dispensers 160B having two inlets are utilized. CNG is delivered from the descending pressure bulk storage bank 120 to a low/medium pressure inlet in the dispensers 160B and CNG is delivered from the high pressure, dispensing storage tank 130 to a high pressure inlet when needed. The dispensers 160B in known manner regulate the pressure equalization rate and dispenser inlet supply of CNG into the vehicle tanks so that complete fills are accomplished.

It may be necessary to use single inlet dispensers 160A with manifold valve 161 if the dispensers 160A are not located near the descending pressure bulk storage bank 120 and the high pressure, dispensing storage tank 130, as it becomes harder to maintain sufficient delivery pressure within the delivery lines as the distance increases.

With this embodiment, a CNG storage and dispensing system 100 capable of simultaneously operating a significant number of individual dispensers 160 is possible. The system 100 provides for simultaneous pressure equalization to all vehicle tanks being refueled at the same time. This cannot be accomplished in the known cascade or buffer systems, and as such this CNG system 100 is able to be utilized with large CNG vehicle fleets or in locations where a large number of CNG vehicles will need to be refilled. The CNG system 100 is especially effective during times of peak traffic demand.

Figure 3:
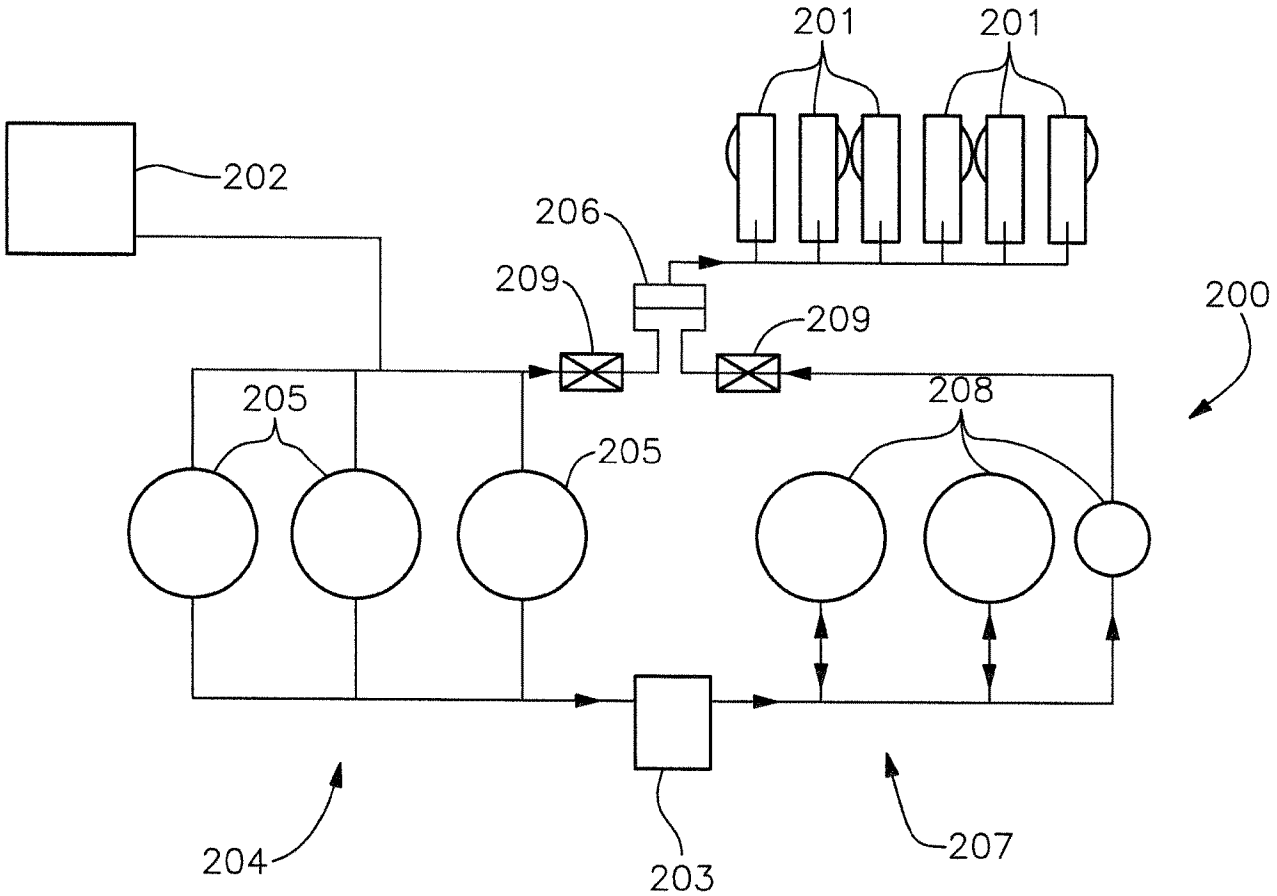
FIG. 3 is an alternate embodiment of a CNG receiving, storing and dispensing fuel system having a single inlet dispenser showing a manifold valve.

FIG. 3 illustrates a basic embodiment of the CNG storage and dispensing system 200 adapted and suitable for dispensing pressure-regulated CNG to a plurality of fast fill post, single inlet dispensers 201 through a manifold valve 206. Fast fill posts 201 are fill posts, i.e., refueling devices for CNG powered vehicles which are designed and structured to supply the CNG at a much faster rate than fill posts, which can take as long as overnight to complete a refill. The fast fill posts 201 are provided with individual control panels to control delivery pressure. Natural gas is provided form a gas supply source 202, which may comprise a natural gas pipeline, LNG from storage tanks, or CNG or LNG delivered by mobile vehicles such as tanker trucks, trailers, railcars, etc., the latter being described as a virtual pipeline. The delivery method may be continuous, in the instance of a pipeline for example, or periodic, as with delivery tankers or trailers.

As described in, greater detail with refence to the embodiments set forth above, the natural gas is delivered to and received by the descending pressure storage bank 204, which may comprise multiple tanks 205. A conduit delivers CNG from the descending pressure storage bank 204 to the manifold valve 206. When the pressure within the tanks 205 of the descending pressure storage bank 204 drops below the predetermined minimum, gas is delivered through a re-compressor to the dispensing storage bank 207 of tanks 208. A conduit delivers CNG from the dispensing storage bank 207 to the manifold valve 206. First and second backflow preventer valves 209 are positioned in both CNG delivery conduits such that CNG can only flow in one direction from the descending pressure storage bank 204 to the manifold valve 206 and form the dispensing storage bank 207 to the manifold valve 206.

Figure 4:
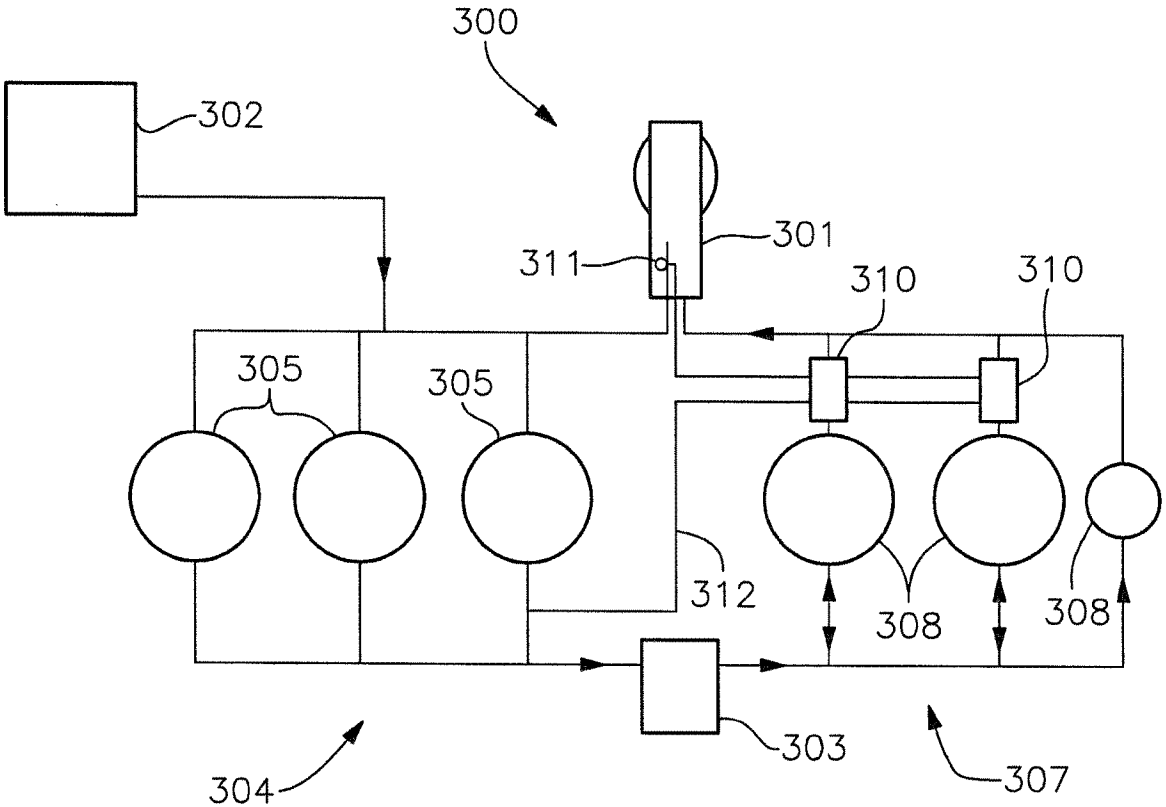
FIG. 4 is an alternate embodiment of a CNG receiving, storing and dispensing fuel system having a single inlet dispenser showing pressure sensor actuator valves.

FIG. 4 illustrates an alternative CNG storage and dispensing system 300 adapted and suitable for dispensing pressure-regulated CNG to a single inlet dispenser 301. Natural gas is provided form a gas supply source 302, which may comprise a natural gas pipeline, LNG from storage tanks, or CNG or LNG delivered by mobile vehicles such as tanker trucks, trailers, railcars, etc., the latter being described as a virtual pipeline. The delivery method may be continuous, in the instance of a pipeline for example, or periodic, as with delivery tankers or trailers.

As described in greater detail with refence to the embodiments set forth above, the natural gas is delivered to and received by the descending pressure storage bank 304, which may comprise multiple tanks 305. A conduit delivers NG from the descending pressure storage bank 304 to the single inlet dispenser 301. When the pressure within the tanks 305 of the descending pressure storage bank 304 drops below the predetermined minimum, gas s delivered through a re-compressor 303 to the dispensing storage bank 307 of tanks 308. A conduit delivers CNG from the dispensing storage bank 307 to the single inlet dispenser 301. An actuator valve 310 is associated with each dispenser tank 308, the actuator valves 310 being controlled by a low pressure sensor 311 that monitors the pressure of the CNG delivered to the single inlet dispenser 301. If the pressure drops below a predetermined minimum, the actuator valves 310 are opened to deliver CNG to the single inlet dispenser 301 from the dispenser storage bank 307. The actuator valves 310 may be operated by a pneumatic gas pressure conduit 312 tapping into a conduit extending from the descending pressure bulk storage bank 304 to the re-compressor 303.

It is contemplated and understood that equivalents and substitutions for elements set forth above may be obvious to those of skill in the art, and therefore the true scope and definition of the invention is to be as set forth in the following claims.

I claim:

1. A compressed natural gas (CNG) storage and dispensing system comprising:

a descending pressure bulk storage bank in fluid communication with a natural gas supply source;

a dispensing storage bank in fluid communication with said descending pressure bulk storage bank;

at least one dispenser adapted to provide CNG to a CNG-powered device, each said at least one dispenser in fluid communication with said descending pressure bulk storage bank and with said dispensing storage bank; and a re-compressor in fluid communication with said descending pressure bulk storage bank and said dispensing storage bank, whereby CNG is delivered from said descending pressure bulk storage bank to said dispensing storage bank as needed to refill said dispensing storage bank;

wherein said at least one dispenser comprises two inlets, and further wherein said descending pressure bulk storage bank is in fluid communication with said at least one dispenser through one of said inlets and wherein said dispensing storage bank is in fluid communication with said at least one dispenser through the other of said inlets.

2. The system of claim 1, wherein said natural gas supply source comprises a natural gas pipeline, and said system further comprises a primary compressor in fluid communication with said natural gas pipeline and said descending pressure bulk storage bank.

3. The system of claim 1, wherein said natural gas supply source comprises transportable LNG supply tanks.

4. The system of claim 1, wherein said natural gas supply source comprises transportable CNG supply tanks.

5. The system of claim 1, further comprising a direct conduit between dispensing storage bank and said descending pressure bulk storage bank such that CNG may be delivered from said descending pressure bulk storage bank directly to said dispensing storage bank as needed to refill said dispensing storage bank.

6. The system of claim 1, wherein CNG is delivered simultaneously to said at least one dispenser from said descending pressure storage bank and said dispensing storage bank.

7. The system of claim 1, wherein said at least one dispenser comprises multiple fueling nozzles and controls the delivery of CNG from said descending pressure bulk storage bank and said dispensing storage bank such that the delivery pressure is equalized through all said fueling nozzles.

8. The system of claim 1, wherein either or both said descending pressure bulk storage bank and said dispensing storage bank comprise a plurality of tanks.

9. The system of claim 2, further comprising a temperature reducing heat exchanger in fluid communication with said primary compressor and said descending pressure hulk storage bank; wherein said temperature reducing heat, exchanger reduces the temperature of said CNG passing between said primary compressor and said descending pressure bulk storage bank.

10. A compressed natural gas (CNG) storage and dispensing system comprising:

a descending pressure bulk storage bank in fluid communication with a natural gas supply source;

a dispensing storage batik in fluid communication with said descending pressure bulk storage bank;

at least one dispenser adapted to provide CNG to a CNG-powered device, each said at least one dispenser in fluid communication with said descending pressure bulk storage bank and with said dispensing storage bank; and a re-compressor in fluid communication with said descending pressure bulk storage bank and said dispensing storage bank, whereby CNG is delivered from said descending pressure bulk storage bank to said dispensing storage bank as needed to refill said dispensing storage bank;

further comprising a backflow preventer in fluid communication between said re-compressor and said dispensing storage bank.

11. The system of claim 10, wherein said at least one dispenser comprises single inlet, and further wherein said descending pressure bulk storage bank and said dispensing storage bank are in fluid communication with said at least, one dispenser through a manifold valve.

12. The system of claim 11, wherein CNG is delivered through said manifold valve to said at least one dispenser first from said descending pressure storage bark and second from said dispensing storage bank.

13. The system of claim 10, wherein said at least one dispenser comprises multiple fueling nozzles; and controls the delivery of CNG from said descending pressure bulk storage bank and said dispensing storage bank such that the delivery pressure is equalized through all said fueling nozzles.

14. The system of claim 10, wherein either or both said descending pressure bulk storage bank and said dispensing storage bank comprise a plurality of tanks.

15. The system of claim 10, further comprising an actuator valve in communication with a low pressure sensor monitoring the pressure of CNG delivered to said at least one dispenser, said actuator valve controlling delivery of CNG from said dispensing storage bank.

16. The system of claim 11, further comprising a first backflow preventer valve in fluid communication between said dispensing storage bank and said manifold valve and a second backflow preventer valve in fluid communication between said descending pressure storage bank and said manifold valve.

17. A method of delivering CNG to a CNG-powered device comprising the steps of:

providing a compressed natural gas (CNG) storage and dispensing system comprising:

a descending pressure bulk storage bank in fluid communication with a natural gas supply source, said natural gas supply source being chosen from the group of natural gas supply sources consisting of a natural gas pipeline, transportable CNG supply tanks and transportable LNG supply tanks;

a dispensing storage bank in fluid communication with said descending pressure bulk storage bank;

at least one dispenser adapted to deliver CNG to a CNG-powered device, each said at least one dispenser in fluid communication with said descending pressure bulk storage bank and with said dispensing storage bank; wherein said at least one dispenser comprises multiple fueling nozzles and is adapted to control the delivery of CNG from said descending pressure bulk storage bank and said dispensing storage bank such that the delivery pressure is equalized through all said fueling nozzles; and a re-compressor in fluid communication between said descending pressure bulk storage bank and a backflow preventer in fluid communication between said re-compressor and said dispensing storage bank;

providing CNG to said descending pressure bulk storage bank and to said dispensing storage bank;

delivering CNG to a CNG-powered device through said at least one dispenser, wherein said CNG is first (delivered from said descending pressure bulk storage bank and then subsequently delivered from said dispensing bulk storage bank in response to a drop in pressure within said descending pressure bulk storage bank below a predetermined pressure minimum, and equalizing the delivery pressure of said CNG delivered to said CNG-powered device;

refilling said descending pressure bulk supply bank from one of said natural gas supply sources as needed; and refilling said dispensing storage bank with CNG from said descending, pressure storage bank as needed by delivering CNG from said descending pressure storage bank through said re-compressor.

18. The method of claim 15, further comprising the step of:

providing a first backflow preventer valve in fluid communication between said dispensing storage bank and said manifold valve and a second backflow preventer valve in fluid communication between said descending pressure storage bank and said manifold valve.

19. The method of claim 15, further comprising the step of:

providing an actuator valve in communication with a low pressure sensor monitoring the pressure of CNG delivered to said at least one dispenser, said actuator valve controlling delivery of CNG from said dispensing storage bank.

* * * * *